US010231530B2

(12) United States Patent
Kang

(10) Patent No.: US 10,231,530 B2
(45) Date of Patent: Mar. 19, 2019

(54) FOUNDATION CONTAINER COMPRISING DISCHARGE PUMP HAVING SHORT WORKING STROKE

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 350 days.

(21) Appl. No.: 15/103,017

(22) PCT Filed: Jan. 23, 2014

(86) PCT No.: PCT/KR2014/000646
§ 371 (c)(1),
(2) Date: Jun. 9, 2016

(87) PCT Pub. No.: WO2015/088100
PCT Pub. Date: Jun. 18, 2015

(65) Prior Publication Data

US 2017/0049213 A1 Feb. 23, 2017

(30) Foreign Application Priority Data

Dec. 12, 2013 (KR) ..... 20-2013-0010347 U

(51) Int. Cl.
*A45D 33/02* (2006.01)
*A45D 40/22* (2006.01)
(Continued)

(52) U.S. Cl.
CPC ..... *A45D 40/22* (2013.01); *A45D 33/006* (2013.01); *A45D 34/00* (2013.01);
(Continued)

(58) Field of Classification Search
CPC .. A45D 40/22; A45D 40/0075; A45D 33/006; A45D 33/003; A45D 33/02;
(Continued)

(56) References Cited

U.S. PATENT DOCUMENTS 9,345,303 B2 * 5/2016 Yoo ..... A45D 33/006
9,894,980 B2 * 2/2018 Kim ..... B65D 47/244
(Continued)

FOREIGN PATENT DOCUMENTS

JP 2002-272530 9/2002
KR 20-0389166 7/2005
(Continued)

*Primary Examiner* — Rachel R Steitz
(74) *Attorney, Agent, or Firm* — Heedong Chae; Lucem, PC

(57) ABSTRACT

A foundation container including a discharge pump having a short working stroke, the foundation container including an outer container main body; an outer container cap coupled to the outer container main body and opened/closed; a container main body coupled inside the outer container main body; and a container cap coupled to the upper portion of the container main body and opened/closed, wherein the foundation container comprises a container interruption plate coupled inside the upper portion of the container main body, a discharge pump coupled to the center of the container interruption plate, and a content diffusion plate coupled to the discharge pump; the discharge pump comprises a pump main body, a pump upper body, a pump inner body, a discharge valve, and an elastic member; and the diffusion plate is configured to extend to the pump upper body.

17 Claims, 17 Drawing Sheets

(51) Int. Cl.

| | |
|---|---|
| ***B05B 11/00*** | (2006.01) |
| ***A45D 34/00*** | (2006.01) |
| ***A45D 33/00*** | (2006.01) |
| ***A45D 40/00*** | (2006.01) |
| ***B65D 83/00*** | (2006.01) |

(52) U.S. Cl.
CPC ..... *A45D 40/0075* (2013.01); *B05B 11/0044* (2018.08); *B05B 11/00416* (2018.08); *B05B 11/3002* (2013.01); *B65D 83/005* (2013.01); *A45D 2200/056* (2013.01)

(58) Field of Classification Search
CPC .. A45D 33/04; A45D 34/00; A45D 2200/056; B05B 11/00416; B05B 11/0016; B05B 11/0048; B05B 11/3002
See application file for complete search history.

(56) References Cited

U.S. PATENT DOCUMENTS

2008/0276956 A1* 11/2008 Cho ..... A45D 33/006 132/294
2011/0126851 A1* 6/2011 Yeom ..... A45D 33/04 132/293
2012/0048294 A1* 3/2012 Yeom ..... A45D 33/04 132/299
2015/0250287 A1* 9/2015 Yoo ..... A45D 33/04 401/130
2016/0015149 A1* 1/2016 Kim ..... A45D 34/00 222/383.1
2016/0227903 A1* 8/2016 Kang ..... A45D 34/00
2017/0095055 A1* 4/2017 Chung ..... A45D 33/008
2017/0347772 A1* 12/2017 Kang ..... A45D 34/00
2018/0002070 A1* 1/2018 Lee ..... A45D 40/0075
2018/0035785 A1* 2/2018 Lee ..... B05B 11/3056
2018/0085767 A1* 3/2018 Kang ..... A45D 40/00
2018/0099789 A1* 4/2018 Kang ..... A45D 40/00
2018/0132592 A1* 5/2018 Chung ..... A45D 33/006
2018/0192760 A1* 7/2018 Lee ..... A45D 33/00

FOREIGN PATENT DOCUMENTS

| | | |
|---|---|---|
| KR | 10-0647455 | 11/2006 |
| KR | 10-1112477 | 2/2012 |
| KR | 20-0461424 | 7/2012 |
| KR | 10-2013-0048082 | 5/2013 |
| KR | 10-1329663 | 11/2013 |

* cited by examiner

FOUNDATION CONTAINER COMPRISING DISCHARGE PUMP HAVING SHORT WORKING STROKE

CROSS-REFERENCE TO RELATED APPLICATION

This application claims the benefit of Korean Application No. 20-2013-0010347, filed on Dec. 12, 2013 with the Korean intellectual Property Office, the disclosure of which is incorporated herein by reference.

TECHNICAL FIELD

The present invention relates to a foundation container including a discharge pump having a short working stroke, and more particularly, to a foundation container including a discharge pump having a short working stroke, the discharge pump being configured such that a pump upper body, which has a content discharge port formed therein, is fitted into an upper portion of a pump main body, which has a content intake port formed therein, a pump inner body, which has an intake valve plate formed thereon, is fitted into the pump main body and the pump upper body, and a discharge valve wing of a discharge valve is coupled to a sealing protruding ring on the upper portion of the pump upper body, thereby vertically moving the pump upper body with respect to the pump main body, such that the volume of a temporary content storage part of the pump inner body is changed, thereby discharging the contents, the foundation container including a content diffusion plate formed integrally with an upper body upper plate of the pump upper body such that the contents are discharged by a predetermined amount, diffused by the diffusion plate, evenly applied on a puff, and then used.

BACKGROUND ART

Conventionally, powder-phase contents are received in a compact container, and a user the powder-phase contents using a puff. However, when the user uses the powder-phase contents, the contents may be scattered in use. When the user applies the contents to the face, the adhesion of the contents to the face may be degraded. In order to solve the problem, foundation having the gel-phase contents has been developed, and the use frequency of the foundation has been gradually increased due to the convenience of use.

In general, the gel-phase contents are produced by mixing mutually different materials, and include emulsified cosmetic materials of water-in-oil (W/O) and oil-in-water (O/W) emulsion cosmetic materials obtained by mixing water-based material and oil-based material using an emulsifying agent including a surface active agent.

The water-in-oil emulsion cosmetic material has a larger quantity of oil than that of water and is oily so that the absorption of skin is slow. Although the touch feeling of the water-in-oil emulsion cosmetic material is heavy, the persistence is longer than that of the oil-in-water cosmetic material. The oil-in-water emulsion cosmetic material has a larger quantity of water than that of oil and is little oily so that the absorption of skin is fast. Although the touch feeling of the water-in-oil emulsion cosmetic material is flash and light, the persistence is low. Therefore, the cosmetics requiring persistence are produced by using the W/O emulsion cosmetic material to increase water resistance against sweat and water.

Although, the touch feeling of the W/O emulsion cosmetic material is heavy and sticky, the defects may be compensated by reducing the viscosity of content. However, when the water-in-oil product having low viscosity remains for a long time in circulation, the aqueous material of internal phase and the oil materials of external phase may be separated from each other. In this case, a user must shake a container to mix the separated aqueous and oil materials with each other for use, which causes the inconvenience of use.

In order to solve the problem, as shown in FIG. 1, there has been developed and suggested a product including an immersing member immersed with a W/O contents having low viscosity and contained in an airless pump container, which is disclosed in Korean Unexamined Patent No. 10-2013-0001688.

As shown in FIG. 1, an immersing member 2000 immersed with gel-phase foundation is contained in a container main body 1000. In order to use the gel-phase foundation immersed in the immersing member 2000, a user presses a pressing button 5000 so that vacuum pressure is generated in the container main body 1000 through the pumping operation of an airless pump 4000. A pushing plate 3000 placed at a lower portion of the container main body 1000 is moved up by the vacuum pressure. Accordingly, the immersing member 2000 immersed with the gel-phase foundation is squeezed and compressed up by the pushing plate 3000, so that the gel-phase foundation is discharged and used.

However, since the immersing member 2000 has a large volume, the pushing plate 3000 may not completely push up the immersing member 2000 only through the pumping operation of the airless pump 4000. Accordingly, the gel-phase foundation immersed in the immersing member 2000 is not used up, so that the contents may be wasted.

Accordingly, in order to prevent the gel-phase foundation from remaining, there has suggested a compact container having an airless pump which is disclosed in Korean Utility Model Registration No. 20-0461424 as shown in FIG. 2.

Since the compact container having the airless pump employs the airless pump 4000, the foundation can be prevented from remaining in the container main body 1000. However, since the airless pump of the conventional compact container must employ an operating piston 4200 and an enclosed piston 4300 due to the structure, a long working stroke is formed. Accordingly, when the airless pump is installed in a flat container such as a compact, the working stroke must be short. In this case, since a small amount of contents are discharged at once, the user must inconveniently pumping the airless pump several times, which complicates the structure of the airless pump 4000 and increases the production costs.

For reference, the structure of the airless pump will be described below. Regarding the structure of the airless pump, as shown in FIGS. 3 and 4, an open/close member 4120 to open/close a content introduction hole 4100, and the operating piston 4200 are installed to receive the elasticity of an elastic member 4400. A cylinder 4600, which is configured to discharge contents from a content storage chamber 4500 through a pressing button 5000 when pressure is applied into the content storage chamber 4500 by the operating piston 4200, is installed in a pump main body 4800.

The enclosed piston 4300 is additionally installed in the operating piston 4200, and the pressing button 5000 is installed in an operating tube 4700 coupled to the operating piston 4200 of the cylinder 4600.

According to the convention content discharge pump having the above configuration, if the pressing button 5000 is pressed, after the air gap is first formed between the enclosed piston 4300 and the operating piston 4200, the enclosed piston 4300 and the operating piston 4200 are moved down together, so that pressure is generated in the content storage chamber 4500. The contents of the operating piston 4200 are discharged through a content transfer path 4220 by the pressure.

In this case, the open/close member 4120 makes close contact with the content introduction hole 4100 due to the compressed elastic member 4400 to block the content introduction hole 4100.

If the pressure applied to the pressing button 5000 is released after discharging the contents by pressing the pressing button 5000 as described above, the operating piston 4200 and the enclosed piston 4300 are moved up together by rebound elasticity accumulated in an elastic member 4400 as shown in FIG. 4.

The operating piston 4200 and the enclosed piston 4300 moved up as described above are stopped since the enclosed piston 4300 makes friction with the inside of the cylinder 4600 in the initial moving-up stage. In this state, the operating piston 4200 is first moved up to close the air gap formed between the operating piston 4200 and the enclosed piston 4300 so that the content transfer path 4220 is blocked, and the elasticity accumulated in the elastic member 4400 is weakened.

In the state that the content transfer path 4220 is blocked as described above, as the operating piston 4200 and the sealing piston 4300 are continuously moved up by the elastic member 4400, the vacuum pressure is generated in the content storage chamber 4500. The open/close member 4120 is separated from the content Introduction hole 4100 by the vacuum pressure generated in the content storage chamber 4500, so that the contents in the container are introduced into the content storage chamber 4500.

The conventional content discharge pump continuously repeats the above operations to discharge the contents.

However, the structure of the conventional content discharge pump is very complicated, so that the productivity may be degraded, and the price of a product may be increased. In addition, since the discharge pump has a long stroke in terms of a structure, when the discharge pump is applied to a product, such as a compact, having a height lower than a width thereof, the mounting space for the discharge pump is narrow, so that the discharge pump may not be mounted. If the size of the conventional discharge pump is reduced in order to overcome the above problem, an amount of discharged contents is excessively reduced, so that the user must pump the discharge pump several times.

Further, according to the conventional foundation container having the airless pump, although the gel-phase foundation can be prevented from remaining, the foundation container has no function of properly mixing the gel-phase foundation divided into W/O and G/W materials. Accordingly, a consumer must inconveniently use the foundation by shaking the foundation container and mixing W/O and O/W materials, which are divided into each other.

Therefore, applicant of the present invention has suggested a foundation container including a discharge pump having a short stroke and a content diffusing member, which is disclosed in Korean Utility Model Application 20-2013-585S as shown in FIG. 5.

In the foundation container, an outer container cap 150 is hinged with an outer container body 100, an inner container body 300 coupled to an inner container cap 400 is mounted in the outer container body 100, an inner container interruption plate 350 is coupled to an inner upper portion of the inner container body 300, a discharge pump 600 is coupled to the center of the inner container interruption plate 350, a content diffusing member 700 is coupled to the upper portion of the discharge pump 600, and the discharge pump 600 is coupled to the inner container interruption plate 350.

The discharge pump 600 used in the foundation container includes a valve body 610, a valve late 640, a pressing button 650, a deformation-press member 660, and an elastic member 670 as shown in FIG. 6.

The valve body 610 includes a valve upper body 620 and a valve lower body 630. The valve upper body 620 is formed at an upper surface thereof with a mounting step 622, at an inner central portion thereof with a valve plate supporting step 624, which protrudes, and formed with a valve lower body coupling part 626 integrally extending downward. The valve lower body 630 is formed at the center thereof with a content discharge port 632. After the valve plate 640 is placed on the valve lower body 630, the valve lower body 630 is inserted into the valve lower body coupling part 626.

The pressing button 650 is coupled to an outer circumferential portion of the valve upper body 620 and formed at the center thereof with a discharge port 651 to discharge contents. A content open/close member 653 is coupled to an inner portion of the discharge port 651 by a rib 652.

The deformation-press member 660 is coupled to the inner portion of the pressing button 650. The deformation-press member 660 is formed at an outer circumferential portion thereof with a coupling step 664, which protrudes, to be mounted on the mounting step 622 of the valve upper body 620. The deformation-press member 660 is formed at the center thereof with a valve protruding ring. The deformation-press member 660 is mounted on the valve upper body 620 to form the internal space between the deformation-press member 660 and the valve body 610. The internal space serves as a temporary storage part TR where contents stay before being discharged through the discharge port 651 of the pressing button 650 after moving through the content discharge port 632 of the valve lower body 630 from the container. In addition, the elastic member 670 is placed on the coupling step 664 formed at the edge of the deformation-press member 660 to press the coupling step 664 of the deformation-press member 660 with respect to the mounting step of the valve upper body 620, so that airtightness is increased and the pressing button 650 is elastically supported.

However, according to the foundation container of the related art, the content discharge pump mounted in the foundation container has a significantly complex structure, and a large number of components are provided, so that the product price is increased. In addition, the components have small sizes and the assembling of the components is difficult, so that the production cost may be increased and product competitiveness may be degraded.

DISCLOSURE

Technical Problem

The present invention is made keeping in mind the above problem occurring in the related art, and an object of the present invention is to provide a foundation container including a discharge pump having a short working stroke, which is configured such that a pump upper body, which has a content discharge port formed therein, is fitted into an upper portion of a pump main body, which has a content intake port formed therein, a pump inner body, which has an intake valve plate formed thereon, is fitted into the pump main body and the pump upper body, and a discharge valve wing of a discharge valve is coupled to a sealing protruding ring on the upper portion of the pump upper body, thereby vertically moving the pump upper body with respect to the pump main body, such that the volume of a temporary content storage part of the pump inner body is changed, thereby discharging the contents, so that operations can be easily performed even with a short working stroke.

Another object of the present invention is to provide a foundation container capable of facilitating the production of a discharge pump for contents by simplifying the structure of the discharge pump, so that the productivity can be increased to lower a product price and to increase product competitiveness.

Still another object of the present invention is to provide a foundation container, in which the structure of a discharge pump for contents is improved to facilitate the assembling of the discharge pump, so that the productivity can be increased to lower a product price and to increase product competitiveness.

Still another object of the present invention is to provide a foundation container capable of discharging gel-phase contents through a discharge pump to prevent gel-phase contents from remaining, and enabling a user to use up the gel-phase contents, so that the contents can be prevented from being wasted.

Still another object of the present invention is to provide a foundation container in which a content diffusing plate is provided integrally with an upper body upper plate of a pump upper body to discharge contents by a predetermined amount, to diffuse the contents to a diffusing plate, and evenly apply the contents to a puff for use.

Still another object of the present invention is to provide a foundation container in which an immersing member is provided on an upper end of a discharge pump to uniformly mix contents divided into a water-in-oil phase and an oil-in-water phase.

Still another object of the present invention is to provide a foundation container in which gel-phase contents are uniformly mixed when discharged by an immersing member, so that a user can conveniently use the foundation container without shaking the foundation container.

Technical Solution

According to the present invention, there is provided a foundation container including a discharge pump having a short working stroke, which includes an outer container main body (10), an outer container cap (20) coupled to the outer container main body (10) to be open or closed, a container main body (30) coupled to an inner portion of the outer container main body (10), and a container cap (40) coupled to an upper portion of the container main body (30) to be open or closed. The foundation container includes a container interruption plate (34) coupled to an inner upper portion of the container main body (30), a discharge pump (50) coupled to a center of the container interruption plate (34), and a content diffusing plate (60) coupled to the discharge pump (50). The discharge pump (50) includes a pump main body (52), a pump upper body (54), a pump inner body (56), a discharge valve (57), and an elastic member (53), the container interruption plate (34) extends to a pump main body (52), and the content diffusing plate (60) extends to the pump upper body (54).

The pump main body (52) has a main body lower plate (521) formed at the center thereof with a content intake port (522). The pump upper body (54) is coupled to the upper portion of the pump main body (52) to vertically move with respect to the pump main body (52) so that a pumping operation is performed.

The pump upper body (54) has an upper body upper plate (541) formed at the center thereof with a discharge valve coupling space (542), which is recessed, and a sealing protruding ring (544) having a content discharge port (543) is formed in the center of the discharge valve coupling space (542).

The pump inner body (56) has lateral sides to form the shape a cylinder including inner body barrel walls (561). The pump inner body (56) is formed at an inner lower portion thereof with an intake valve plate (563) coupled to an elastic member (562). In addition, the inner body barrel wall (561) is formed at the upper portion thereof with a vertical coupling piece (565) coupled to a horizontal connection piece (564), an upper side surface extension piece (566) extends outward from an upper end portion of the vertical coupling piece (565), and a lower side surface extension piece (567) extends outward from a lower end portion of the inner body barrel wall (561).

The discharge valve (57) is coupled to the discharge valve coupling space (542) of the pump upper body (54) and formed at an inner side thereof with a discharge valve wing (571) to make close contact with the sealing protruding ring (544) of the pump upper body (54).

The elastic member (58) is fitted around an outer portion of the pump inner body (56), so that a lower end of the elastic member (58) is mounted on the lower side surface extension piece (567) of the pump inner body (56), and an upper end of the elastic member (58) elastically supports a lower portion of the upper side surface extension piece (566) to extend the pump inner body (56) vertically, and elastically supports the pump main body (52) coupled to the lower side surface extension piece (567) and the pump upper body (54) coupled to the upper side surface extension piece (566).

The discharge-valve coupling member (59) is coupled to the upper portion of the discharge valve (57) and coupled to the discharge valve coupling space (542) of the pump upper body (54) to prevent the deviation of the discharge valve (57). The discharge valve (57) may be coupled to the discharge valve coupling space (542) of the pump upper body (54) individually or through the discharge-valve coupling member (59).

Advantageous Effects

As described above, according to the present invention, there is provided the foundation container including the discharge pump having the short working stroke and the content diffusing plate. The discharge pump is provided such that a pump upper body, which has a content discharge port formed therein, is fitted into an upper portion of a pump main body, which has a content intake port formed therein, a pump inner body, which has an intake valve plate formed thereon, is fitted into the pump main body and the pump upper body, and a discharge valve wing of a discharge valve is coupled to a sealing protruding ring on the upper portion of the pump upper body, thereby vertically moving the pump upper body with respect to the pump main body, such that the volume of a temporary content storage part of the pump inner body is changed to discharge the contents, so operations can be easily performed even with a short working stroke.

In addition, according to the foundation container of the present invention, the discharge pump for contents can be easily produced by simplifying the structure of the discharge pump, so that the productivity can be increased to lower a product price and to increase product competitiveness.

Further, according to the present invention, the structure of a discharge pump for contents is improved to facilitate the assembling of the discharge pump, so that the productivity can be increased to lower a product price and to increase product competitiveness.

Further, according to the foundation container of the present invention, gel-phase contents can be discharged through the discharge pump to prevent gel-phase contents from remaining, and enabling a user to use up the gel-phase contents, so that the contents can be prevented from being wasted.

In addition, according to the foundation container of the present invention, the content diffusing plate is provided integrally with the upper body upper plate of the pump upper body to discharge contents by a predetermined amount, to diffuse the contents to a diffusing plate, and to evenly apply the contents to a puff for use.

In addition, according to the foundation container of the present invention, the immersing member is provided on the upper end of the discharge pump to uniformly mix contents divided into a water-in-oil phase and an oil-in-water phase.

In addition, according to the foundation container of the present invention, gel-phase contents are uniformly mixed when discharged by the immersing member, so that a user can conveniently use the foundation container without shaking the foundation container.

BEST MODE

Mode for Invention

Hereinafter, a foundation container including a discharge pump having a short working stroke and a content diffusing plate according to the embodiment of the present invention will be described with reference to accompanying drawings.

Figure 7:
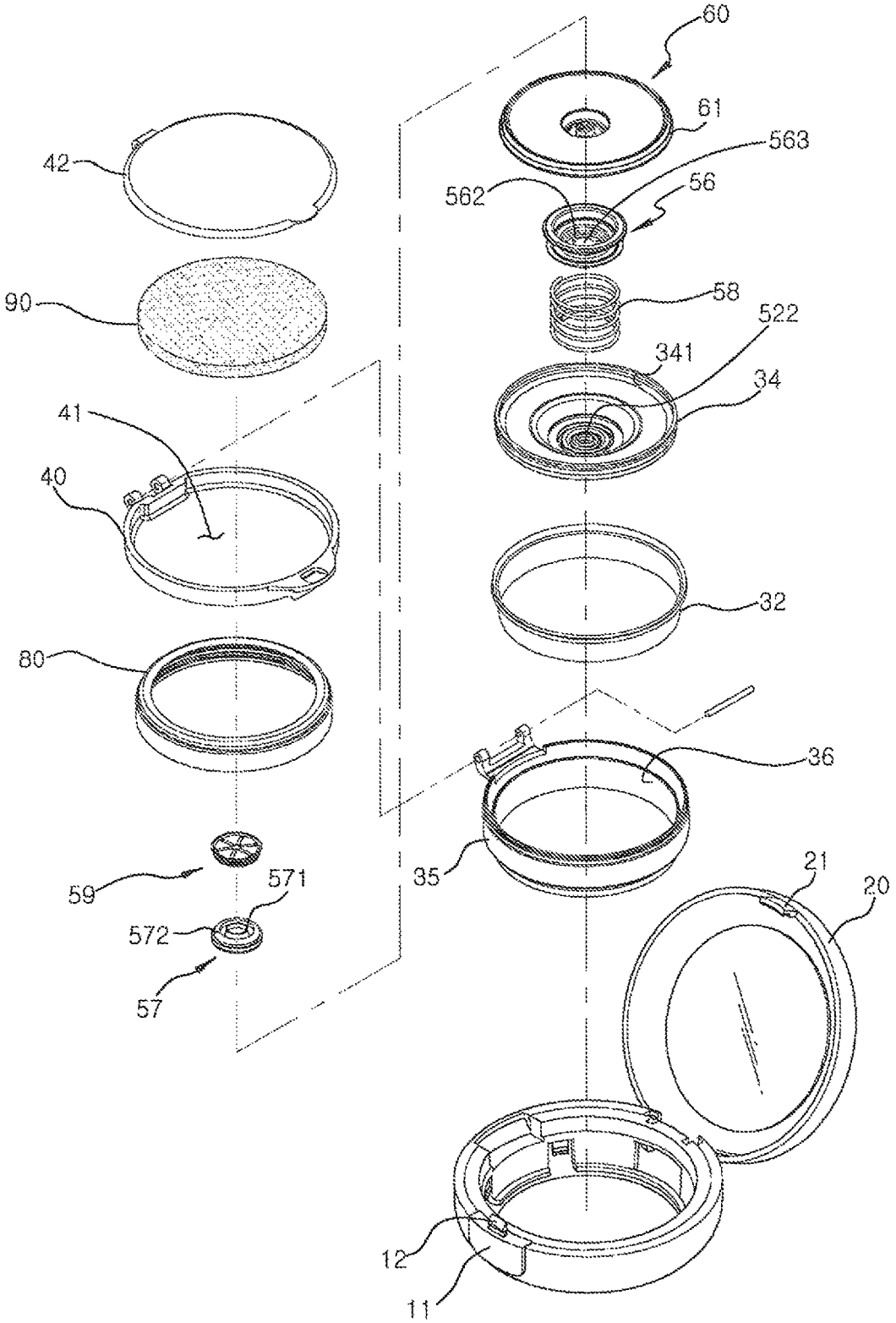
FIG. 7 is an exploded perspective view showing a foundation container according to the present invention.
Figure 8:
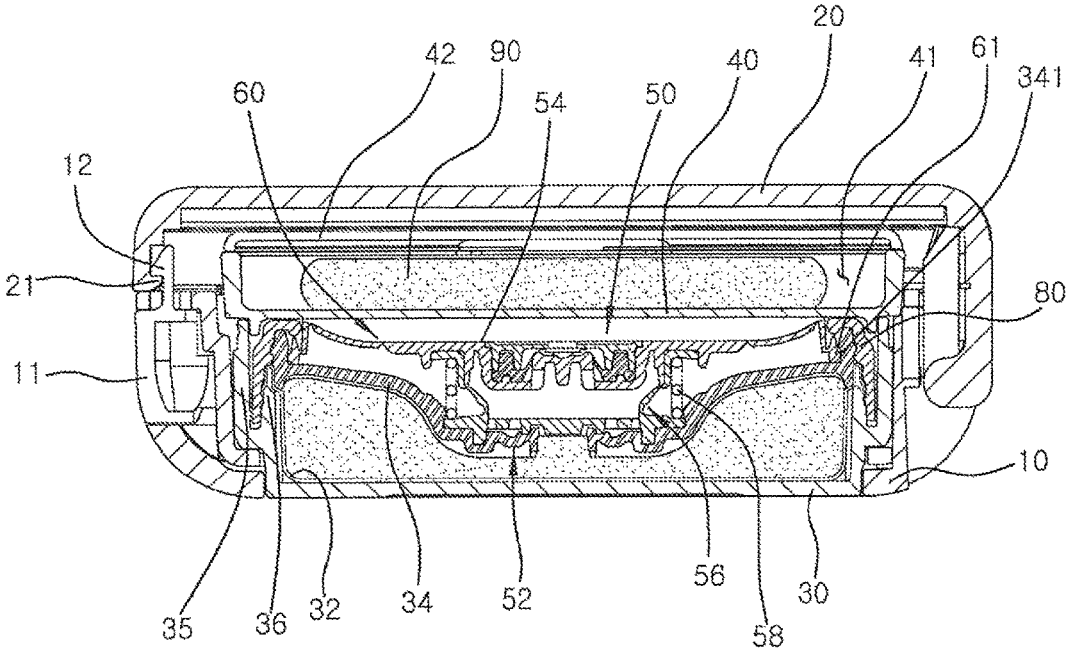
FIG. 8 is a sectional view showing the foundation container according to the present invention.
Figure 9:
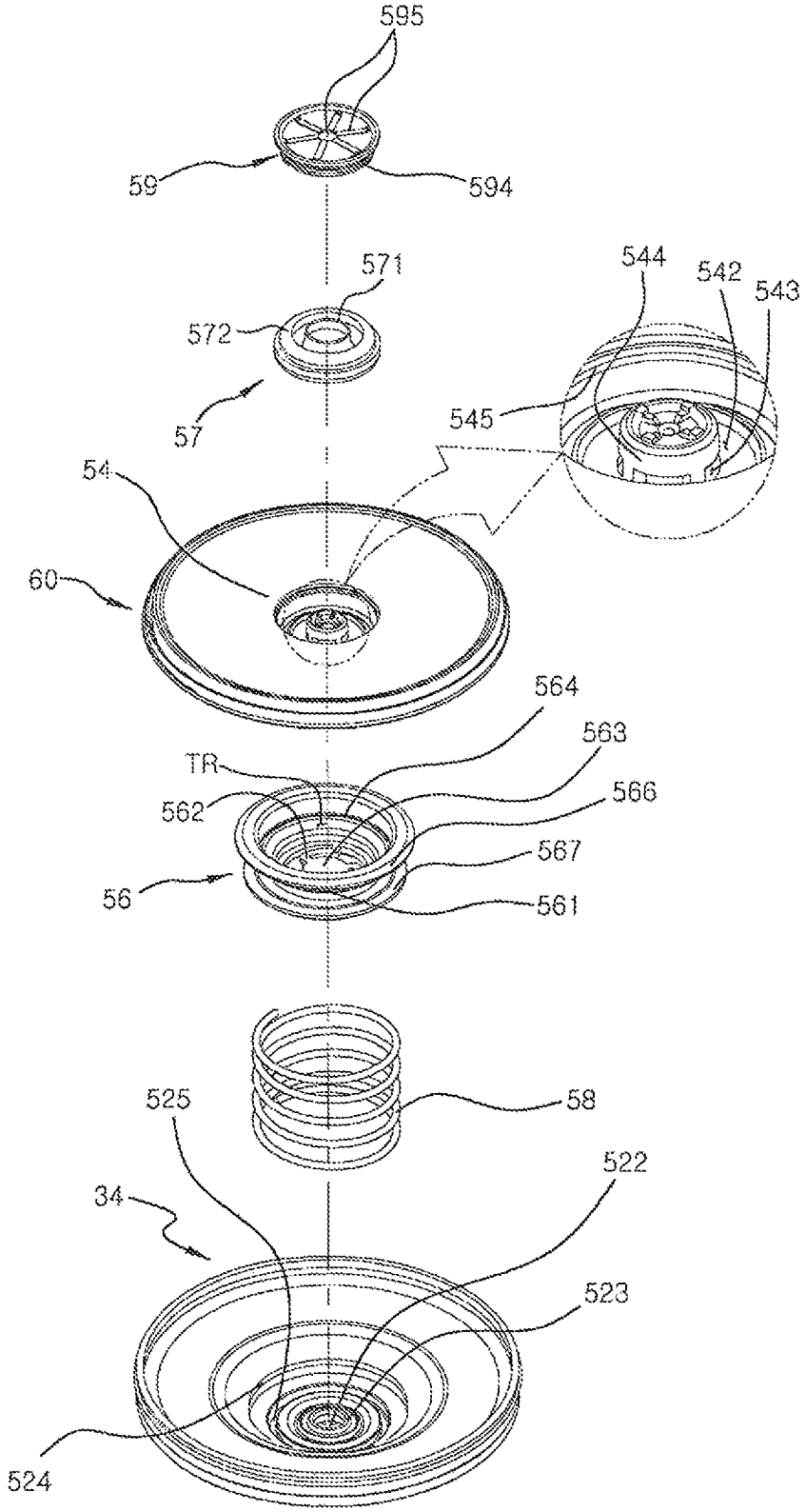
FIG. 9 is an exploded perspective view showing the discharge pump used in the foundation container according to the present invention.
Figure 10:
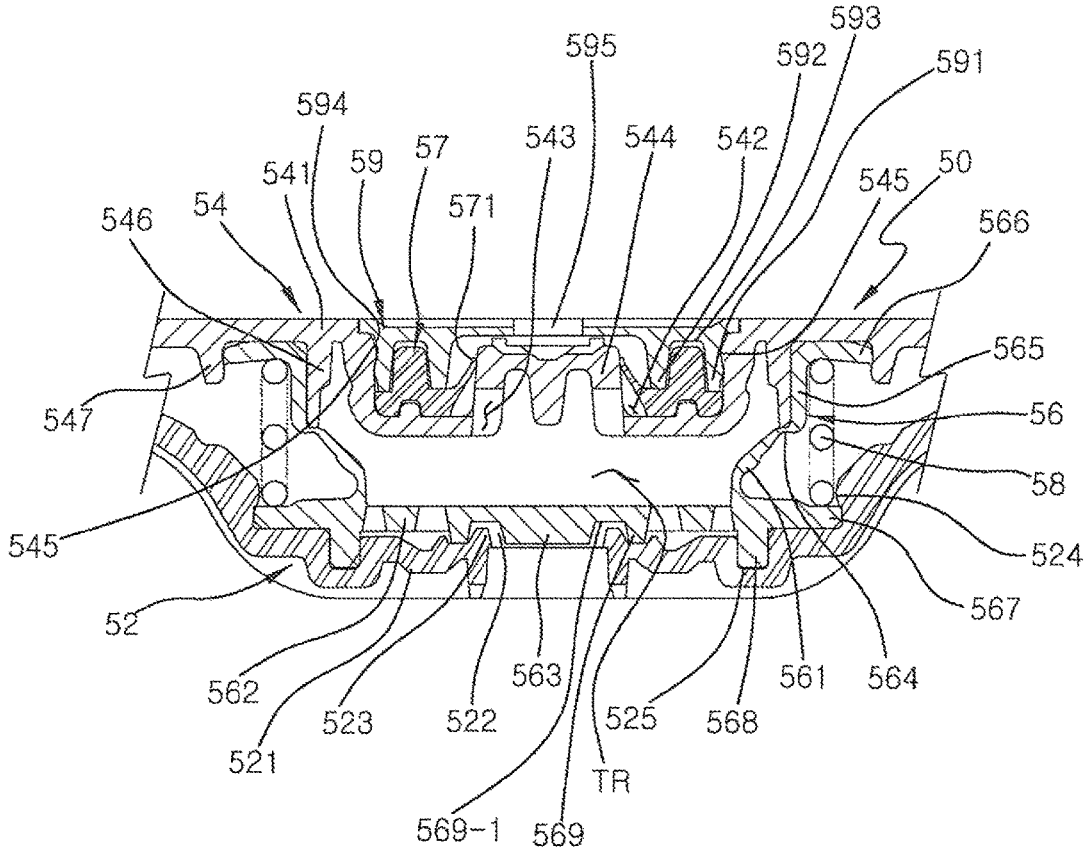
FIG. 10 is a sectional view showing the discharge pump used in the foundation container according to the present invention.
Figure 11:
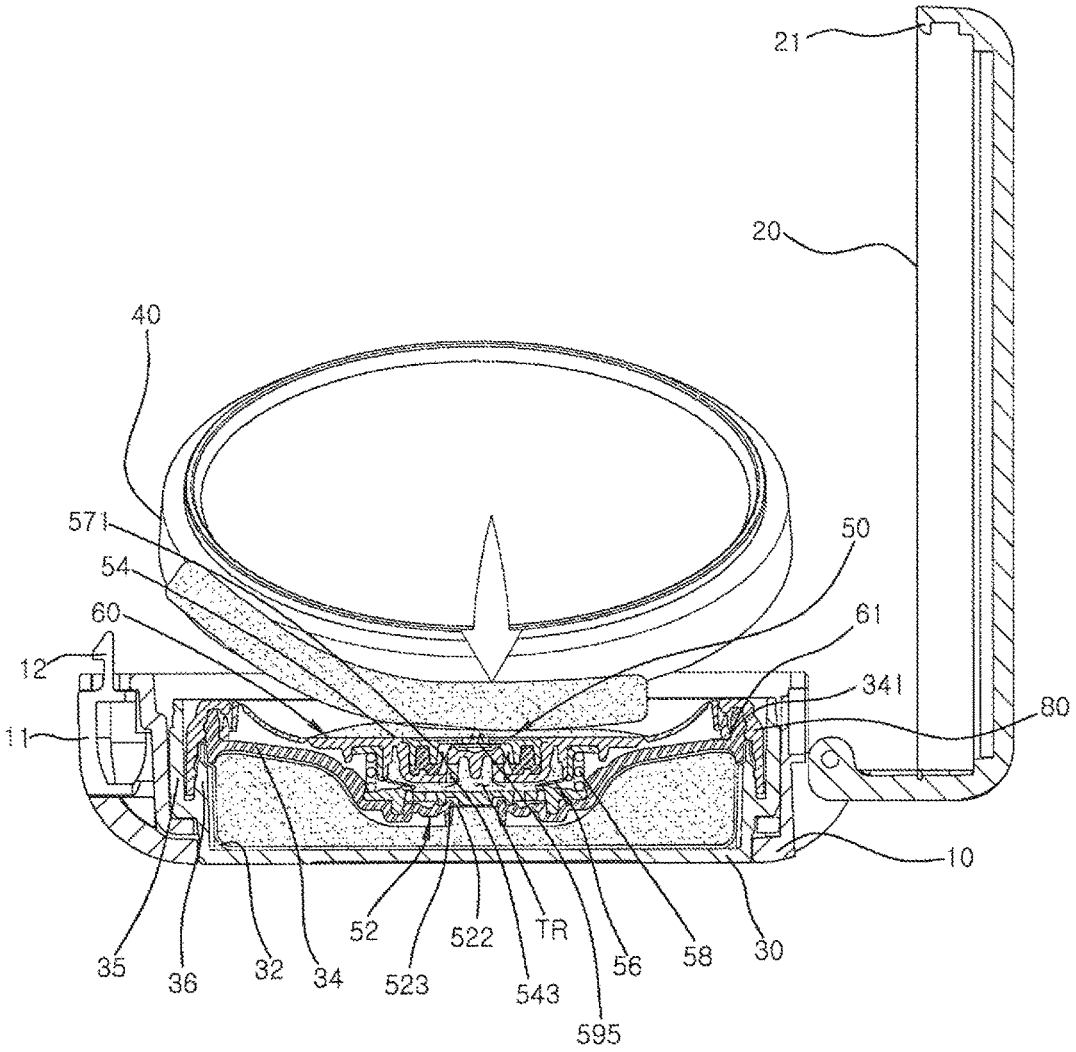
FIG. 11 is a sectional view showing that the contents are discharged by operating the foundation container according to the present invention.
Figure 13:
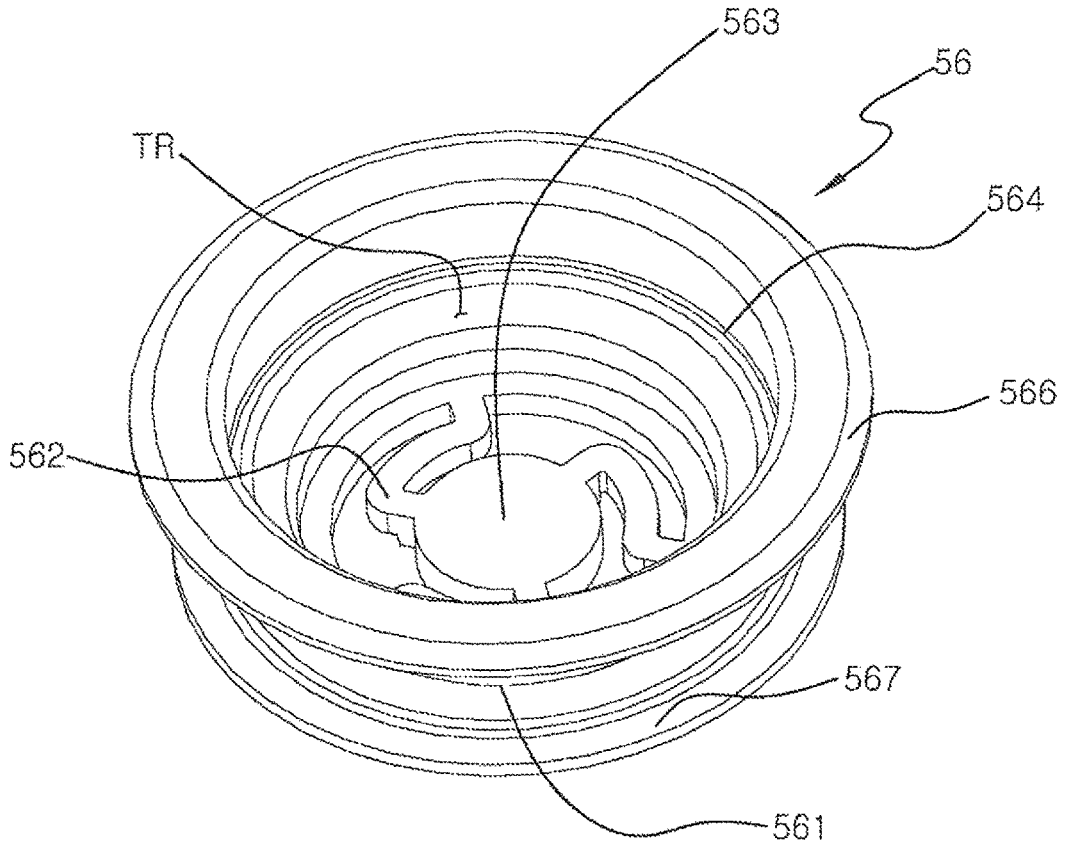
FIG. 13 is a perspective view showing a pump inner body of the foundation container according to the present invention.
Figure 14:
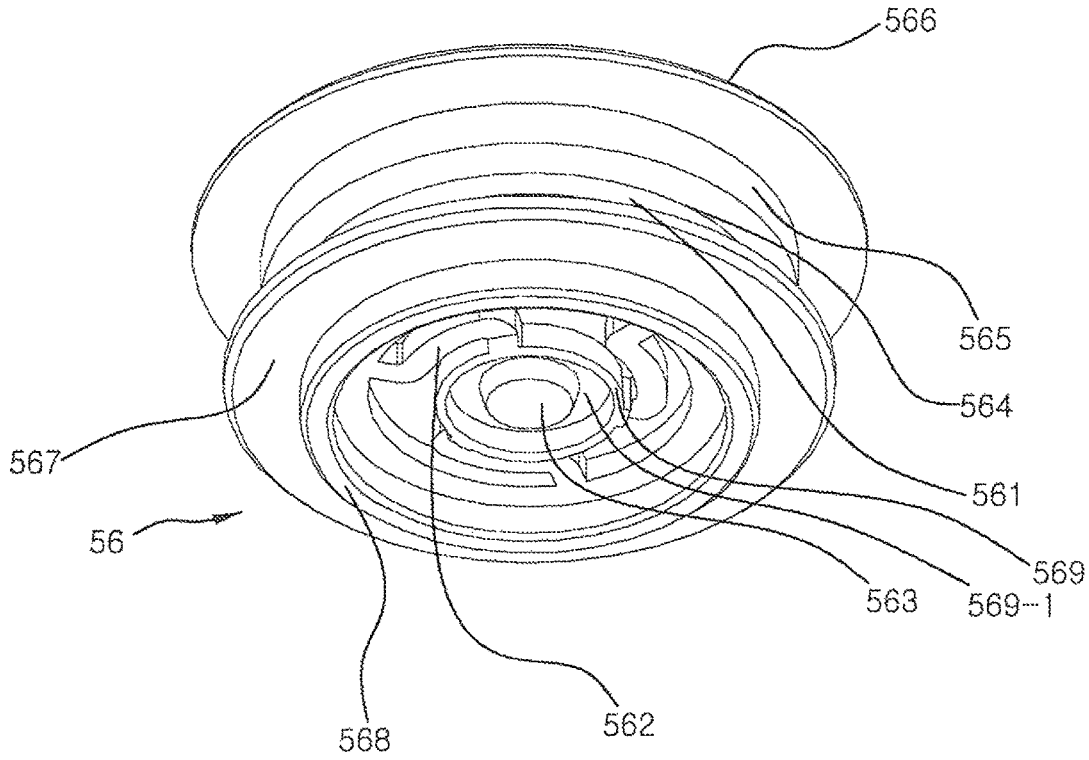
FIG. 14 is a bottom perspective view showing the pump inner body of the foundation container according to the present invention.
Figure 15:
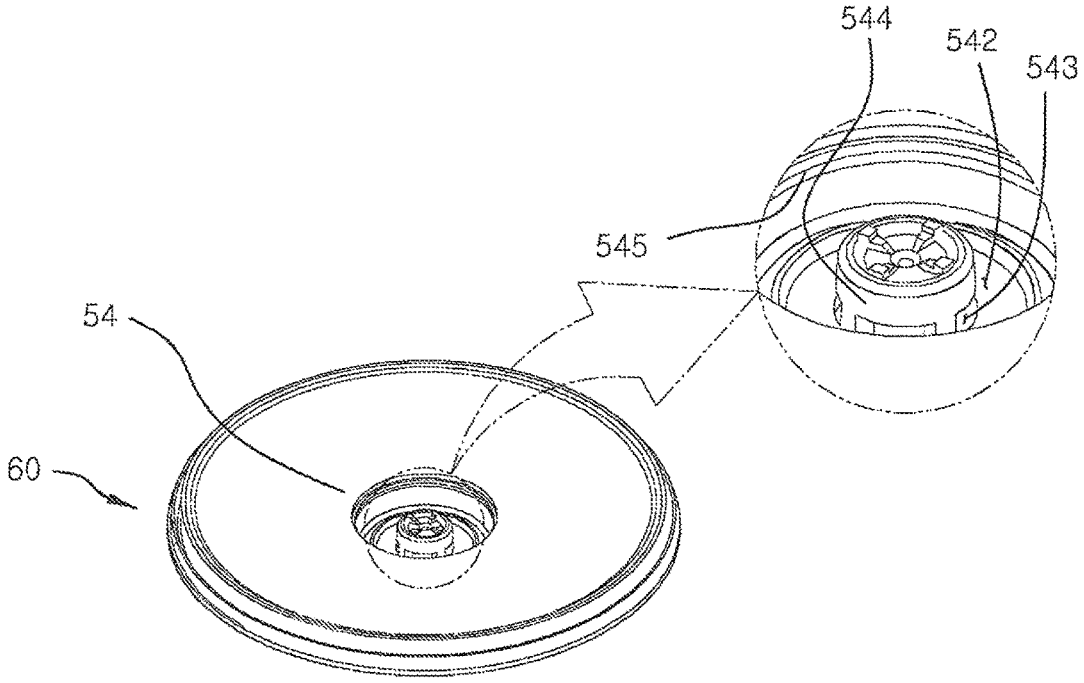
FIG. 15 is a perspective view showing a content diffusing plate of the foundation container according to the present invention.
Figure 16:
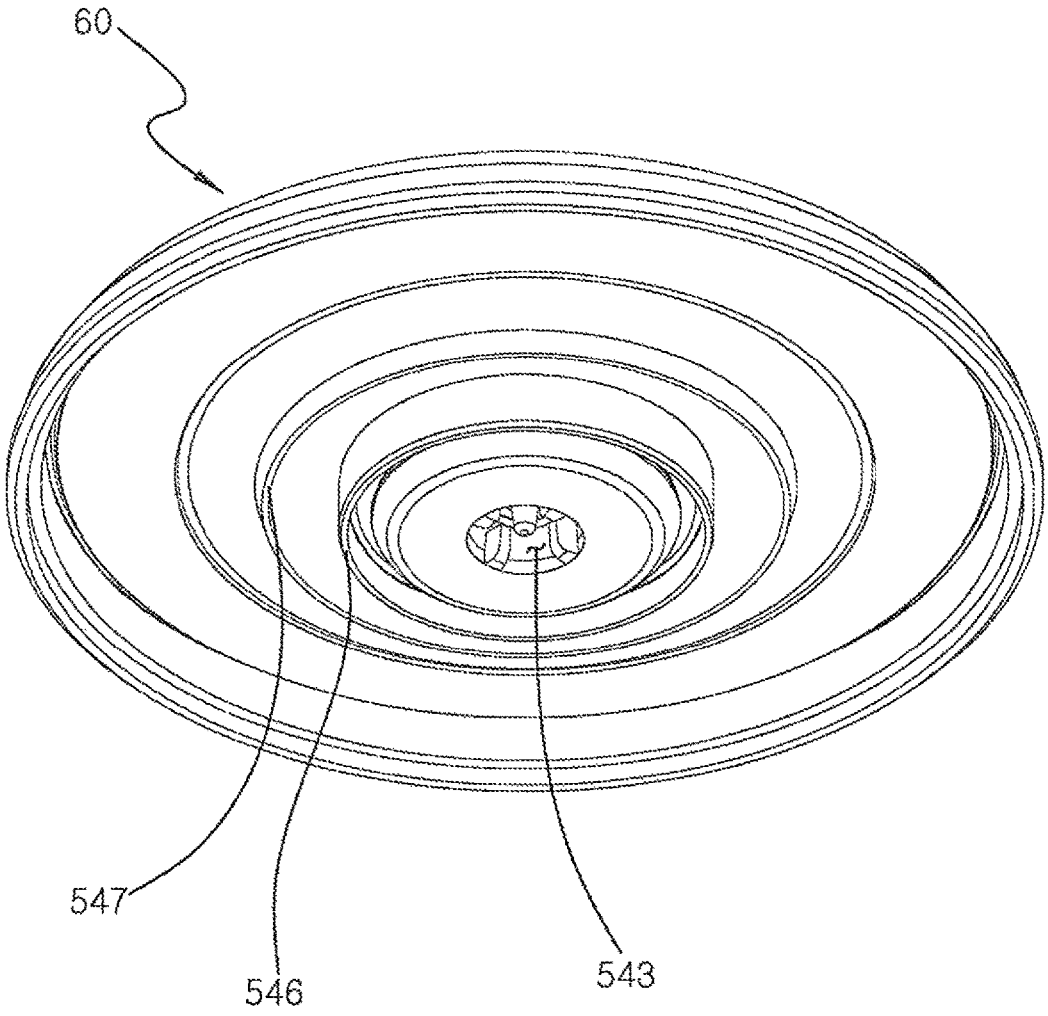
FIG. 16 is a bottom perspective view showing the content diffusing plate of the foundation container according to the present invention.

FIG. 7 is an exploded perspective view showing a foundation container according to the present invention. FIG. 8 is a sectional view showing the foundation container according to the present invention. FIG. 9 is an exploded perspective view showing the discharge pump used in the foundation container according to the present invention. FIG. 10 is a sectional view showing the discharge pump used in the foundation container according to the present invention. FIG. 13 is a perspective view showing a pump inner body of the foundation container according to the present invention. FIG. 14 is a bottom perspective view showing the pump inner body of the foundation container according to the present invention. FIG. 15 is a perspective view showing a content diffusing plate of the foundation container according to the present invention. FIG. 16 is a bottom perspective view showing the content diffusing plate of the foundation container according to the present invention.

The foundation container according to the embodiment of the present invention includes an outer container main body 10 and an outer container cap 20 coupled to the outer container main body 10 to be open/closed. In addition, the foundation container includes a container main body 30 coupled to an inner portion of the outer container main body 10, and a container cap 40 coupled to an upper portion of the container main body 30. The foundation container includes a container interruption plate 34 coupled to an inner upper portion of the container main body 30, a discharge pump 50 coupled to a center of the container interruption plate 34, and a content diffusing plate 60 coupled to the discharge pump 50. The discharge pump 50 includes a pump main body 52, a pump upper body 54, a pump inner body 56, a discharge valve 57, and an elastic member 58, and the content diffusing plate 60 extends to the pump upper body 54.

According to the present invention, although the description has been made in that the container main body 30 is inserted into the outer container main body 10, the outer container main body 10 and the container main body 30 may be formed integrally with each other. In addition, according to the present invention, a sealing ring may be further coupled to an outer circumferential surface of the container interruption plate 34 to enhance a sealing force.

The container cap 40 may be provided in an upper portion thereof with a puff receiving space 41 in which a puff 90 may be received, and a puff cover 42 may be coupled to an upper end of the container cap 40.

Figure 17:
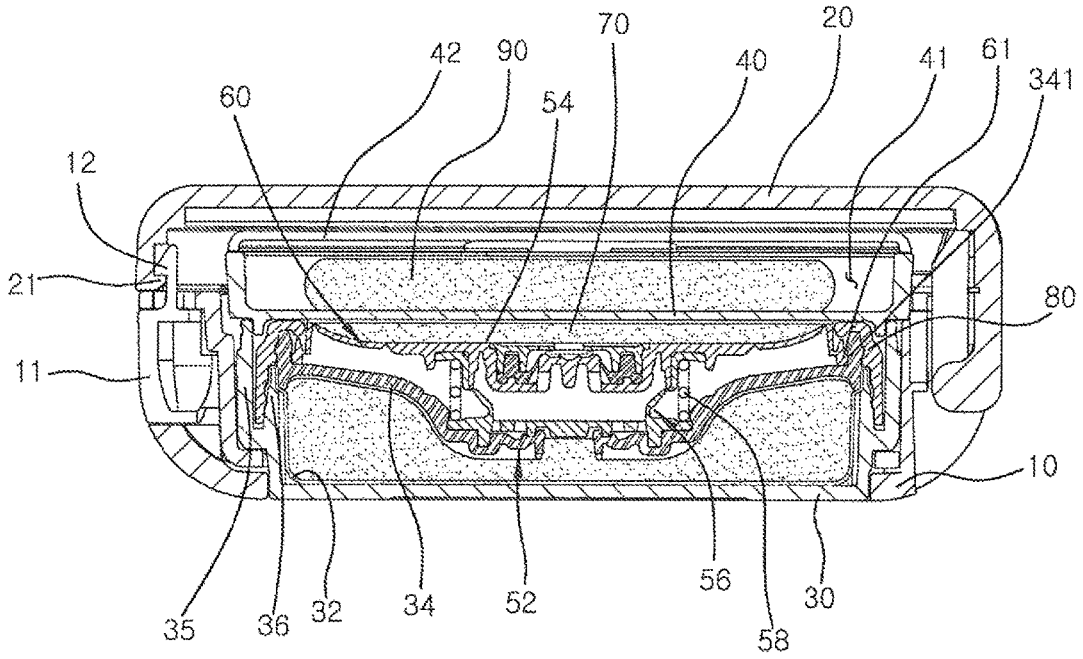
FIG. 17 is a sectional view showing a foundation container according to another embodiment of the present invention.

As shown in FIG. 17, an immersing member 70 may be further coupled to the content diffusing plate 60. The immersing member 70 is immersed with the contents widely flowing through the content diffusing plate 60 after being discharged from a content discharge port 543 of the pump upper body 54.

The immersing member 70 is provided in the form of open cell foam. The gel-phase contents are not divided into a water-in-oil ingredient and an oil-in-water ingredient due to the surficial tension of the foam.

The immersing member 70 may include at least one material selected from the group consisting of butadiene rubber (BR), styrene butadiene rubber (SBR), natural rubber (NR), liquid polyurethane, dry polyurethane, polyether, polyester, polyvinyl chloride, polyethylene, ethylene vinyl acetate (EVA), latex, silicone, styrene isoprene styrene (SIS), styrene ethylene butylene styrene (SEBS), polyvinyl alcohol (PVA), silicone elastomers, nitrile rubbers, butyl rubbers and neoprene.

A fixing member 80 is preferably coupled to an upper portion of the container main body 30 to prevent the deviation of the container interruption plate 34, the content diffusing plate 60, and the immersing member 70.

The fixing member 80 is fixedly fitted between an outer wall 35 and an inner wall 36 of the container main body 30 to prevent the deviation of the container interruption plate 34 and the content diffusing plate 60.

The container main body 30 is received in the outer container main body 10. A button 11 is formed an outer lateral side of the outer container main body 10. A locking protrusion 12, which extends from an upper portion of the button 11, is moved back through the pressing of the button 11 by a user and thus unlocked from a hook 21 of the outer container cap 20 so that the outer container main body 10 is open.

The outer container cap 20, which covers an upper portion of the outer container main body 10, is hinged with the outer container main body 10 to open or close the outer container main body 10. The outer container cap 20 is formed at one side thereof with the hook 21, the hook 21 has the shape of a protrusion corresponding to the locking protrusion 12.

The container main body 30 is provided therein with a thin auxiliary container 32, and the thin auxiliary container 32, which receives contents, is formed of a thin and deformable material. The thin auxiliary container 32 may include one of a plastic material, a synthetic resin material, a general rubber, or an elastomer, a silicon rubber, and NBR rubber. According to the present invention, the thin auxiliary container 32 is fitted between the container main body 30 and the container interruption plate 34 to enhance a sealing force.

Figure 1:
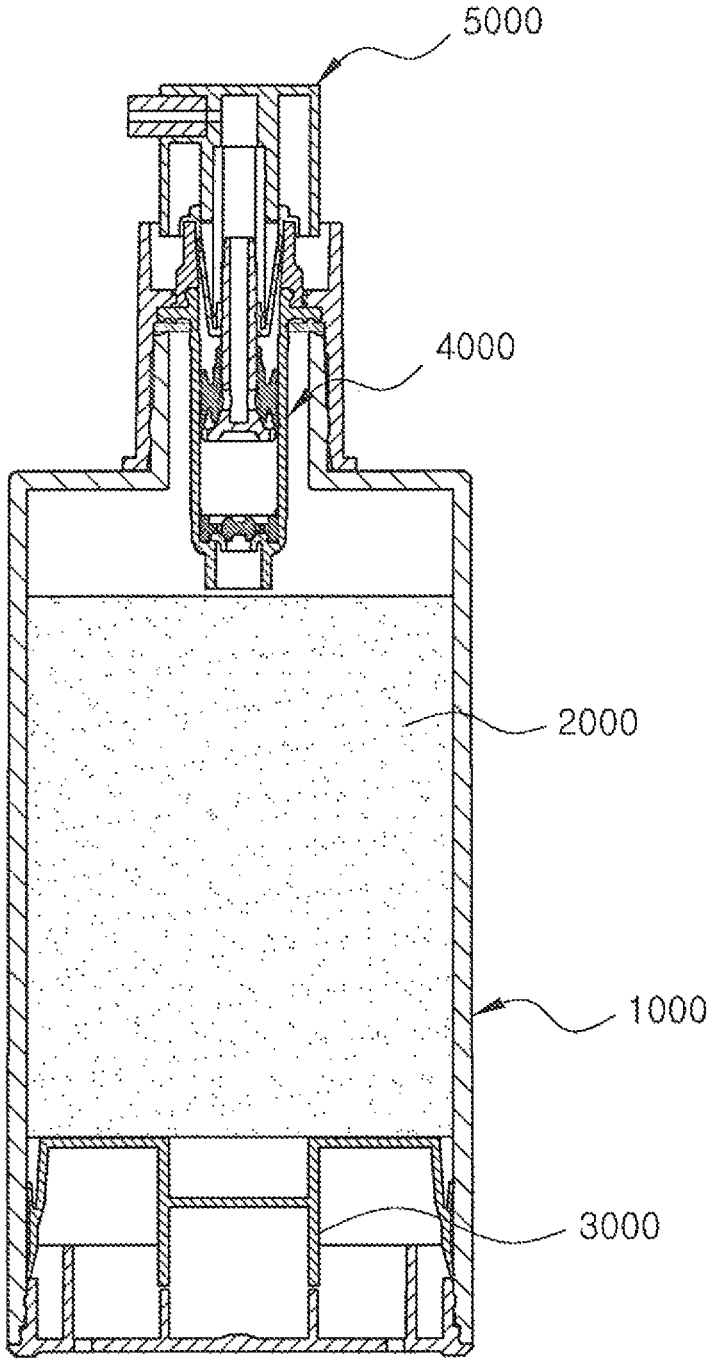
FIG. 1 is a sectional view showing a cosmetic container having an immersing member according to the related art.
Figure 2:
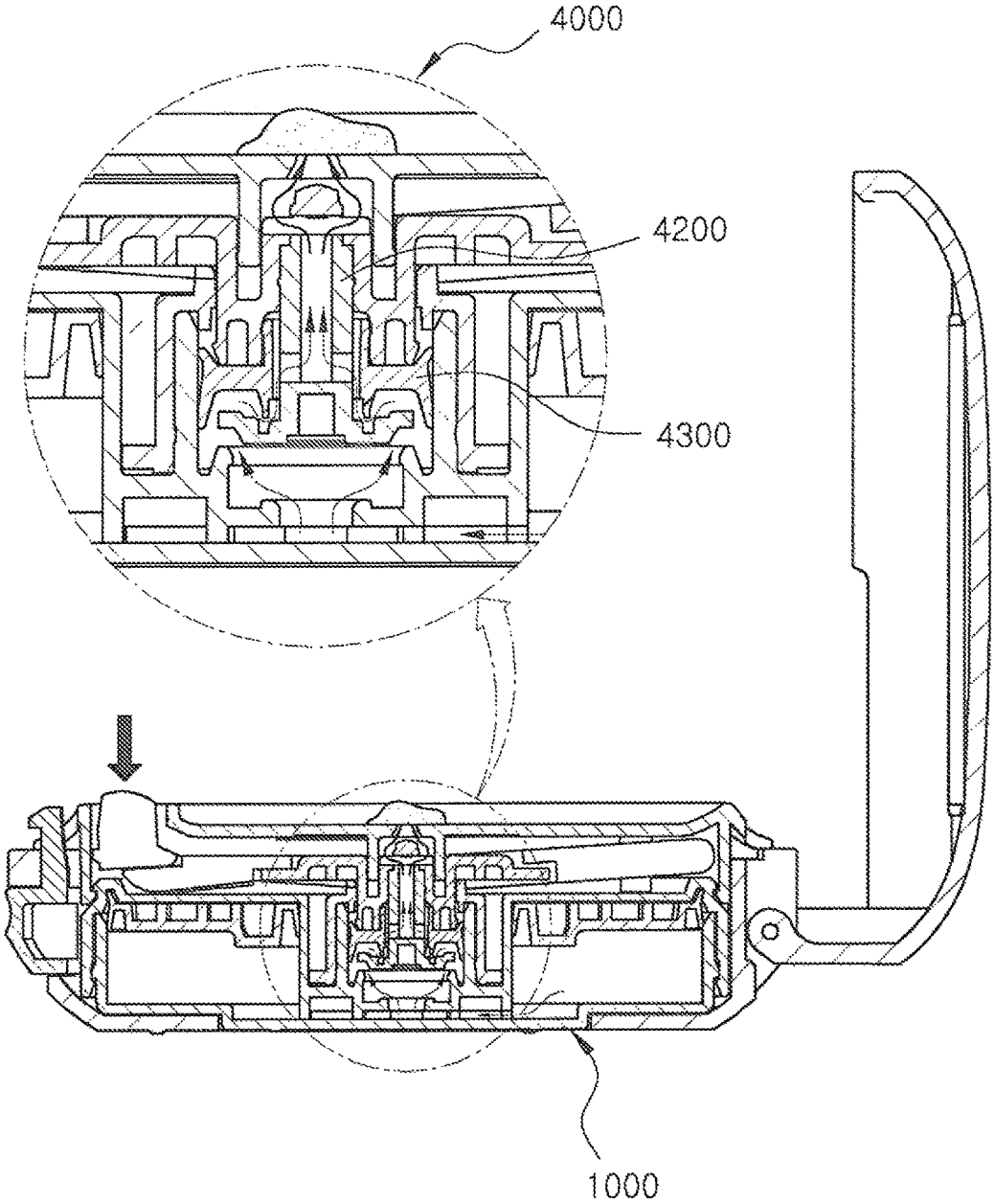
FIG. 2 is a sectional view showing a compact container having an airless pump according to the related art.
Figure 3:
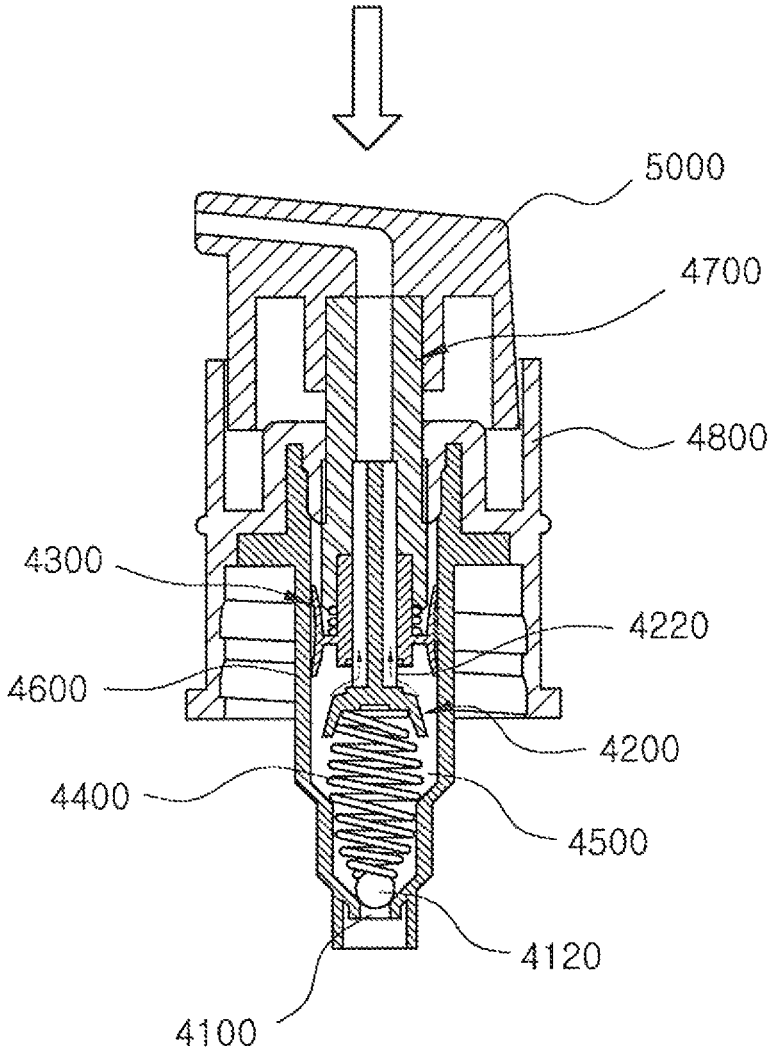
FIG. 3 is a view showing that contents are discharged by operating a content discharge pump according to the related art.
Figure 4:
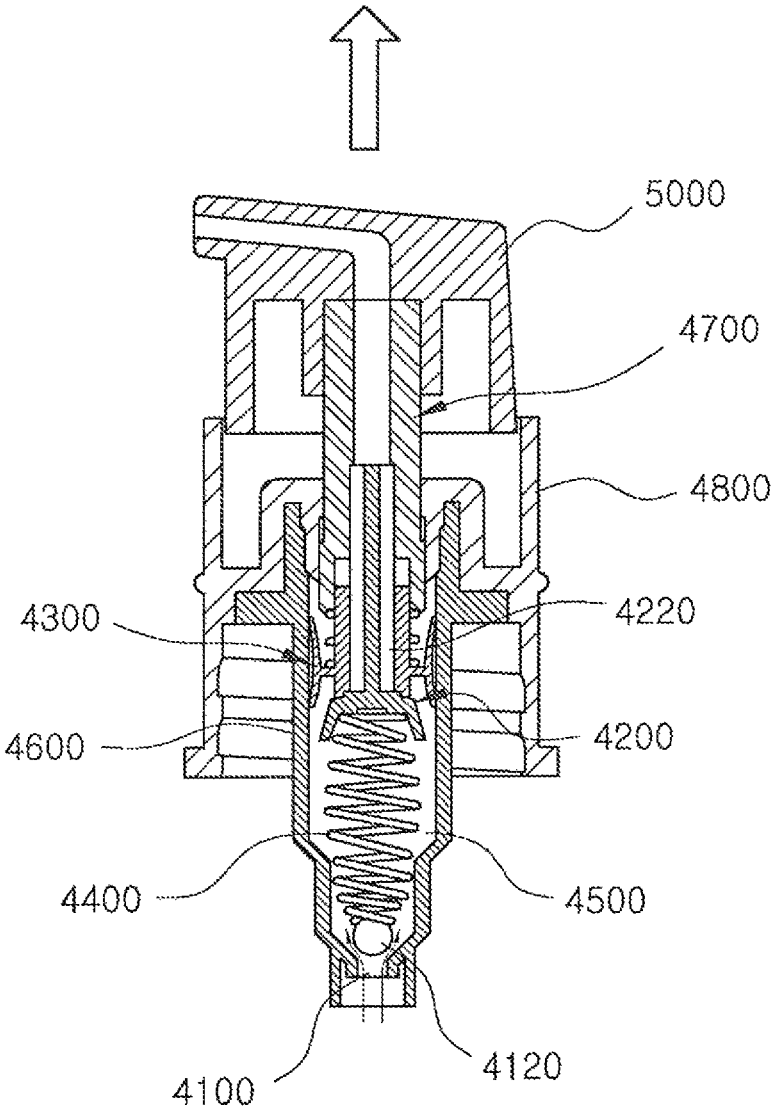
FIG. 4 is a view showing that the content discharge pump is recovered to the original state thereof as the press applied to the content discharge pump is released according to the related art.
Figure 5:
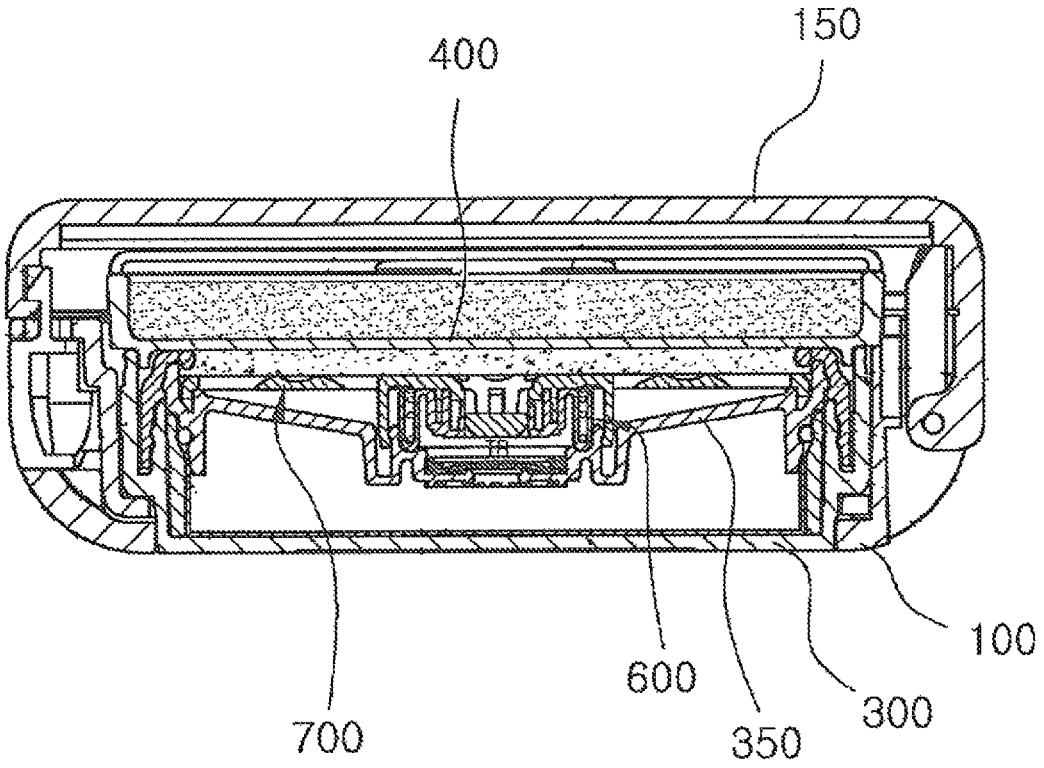
FIG. 5 is a sectional view showing a foundation container according to the related art.
Figure 6:
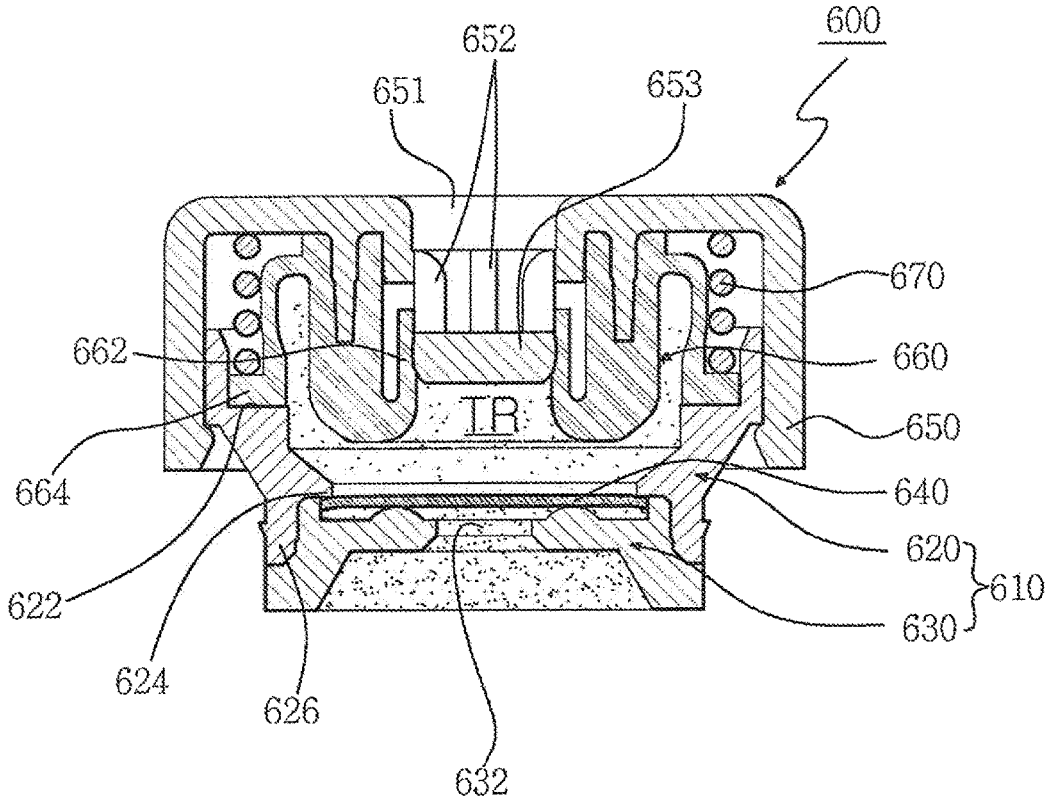
FIG. 6 is a sectional view showing the discharge pump used in the foundation container according to the related art.

The thin auxiliary container 32 may be substituted with a pushing plate 3000 as shown in FIG. 1.

Regarding the thin auxiliary container 32 or the pushing plate 3000 formed in the container main body 30, the thin auxiliary container 32 is crumpled and moved up by the volume of contents discharged through the discharge pump 50, or the pushing plate 3000 slides up so that the pushing plate 3000 occupies the place of the discharged contents.

The container main body 30 has the shape of a bowl to receive the contents together with the thin auxiliary container 32, and the lateral side of the container main body 30 includes an outer wall 35 and an inner wall 36, so that a space for the fitting of the fixing member 80 is formed between the outer wall 35 and the inner wall 36.

The container interruption plate 34 is coupled to the upper end of the container main body 30 to prevent the contents from leaking from the container main body 30, and has the center coupled to the pump main body 52 of the discharge pump 50.

The container interruption plate 34 is formed in an inner circumferential surface thereof with a coupling groove 341, and a coupling protrusion 61 formed in an outer circumferential surface of the content diffusing plate 60 is fitted in the coupling groove 341. The container interruption plate 34 may be formed integrally with the pump main body 52, or separately from the pump main body 52. According to the present invention, the container interruption plate 34 is formed integrally with the pump main body 52.

As shown in FIGS. 9 and 10, the discharge pump 50 includes a pump main body 52, a pump upper body 54, a pump inner body 56, a discharge valve 57, and an elastic member 58.

The pump main body 52 is coupled to the center of the container interruption plate 34. The pump main body 52 may be formed integrally with the container interruption plate 34, or separately from the container interruption plate 34. According to the present invention, the pump main body 52 is formed integrally with the container interruption plate 34.

The pump main body 52 is formed at a lower portion thereof with a main body lower plats 521, and the main body lower plate 521 is formed at the center thereof with a content intake port 522. The content intake port 522 is formed at an outer portion thereof with an intake-port annular protrusion 523, and formed on an inner lateral side thereof with an inner body locking step 524 to which a lower side surface extension piece 567 of a pump inner body 56 is locked. An inner body coupling groove 525 is formed between the intake-port annular protrusion 523 and the inner body locking step 524 so that a lower coupling extension piece 568 of the pump inner body 56 is coupled to the inner body coupling groove 525.

The pump upper body 54 is coupled to the upper portion of the pump main body 52 to vertically move with respect to the pump main body 52 so that a pumping operation is performed.

An upper body upper plate 541 is formed at an upper portion of the pump upper body 54, and formed at the center thereof with a discharge valve coupling space 542 which is recessed. A sealing protruding ring 544 having a content discharge port 543 is formed in the center of the discharge valve coupling space 542, and a coupling step 545 is formed on a lateral surface of the discharge valve coupling space 542 for the coupling to the discharge-valve coupling member 59 to prevent the deviation of the discharge valve 57. In addition, a first coupling-extension member 546 extends downward from the upper body upper plate 541 so that the first coupling-extension member 546 is coupled the pump inner body 56, and a second coup ling-extension member 547 is formed outside the first coupling-extension member 546 while being spaced apart from the first coupling-extension member 546.

The pump inner body 56 is coupled to inner portions of the pump main body 52 and the pump upper body 54. The lateral sides of the pump inner body 56 form the shape a cylinder including inner body barrel walls 561. The pump inner body 56 is formed at an inner lower portion thereof with an intake valve plate 563 coupled to an elastic member 562. In addition, the inner body barrel wall 561 is formed at the upper portion thereof with a vertical coupling piece 565 coupled to a horizontal connection piece 564, an upper side surface extension piece 566 extends outward from an upper end portion of the vertical coupling piece 565, and a lower side surface extension piece 567 extends outward from a lower end portion of the inner body barrel wall 561.

Preferably, the intake valve plate 563 protrudes downward and is fitted into the content intake port 522 of the pump main body 52. In addition, an intake-valve-plate annular protrusion 569 is formed outside the intake valve plate 563 while being spaced apart from the intake valve plate 563 by a predetermined distance. A close contact groove 569-1 is preferably formed between the intake-valve-plate annular protrusion 569 and the intake valve plate 563 so that the intake-port annular protrusion 523 of the pump main body 52 is inserted into the close contact groove 569-1.

The inner body barrel wall 561 of the pump inner body 55 must be formed of an excellent elastic material since the inner body barrel wall 561 is folded or unfolded. Preferably, the inner body barrel wall 561 is formed of at least one of materials, general rubber, elastomer, silicone rubber, NBR rubber, polyethylene (PE), and polypropylene (PP), which represent excellent elasticity.

The discharge valve 57 is coupled to the discharge valve coupling space 542 of the pump upper body 54, formed at an inner side thereof with a discharge valve wing 571, and formed at an upper portion thereof with an auxiliary coupling protruding ring 572 fitted around the discharge-valve coupling member 59. The discharge valve 57 may be coupled to the discharge valve coupling space 542 directly or through the discharge-valve coupling member 59. According to the present invention, the discharge valve 57 is coupled to the discharge valve coupling space 542 through the discharge-valve coupling member 59.

Since the discharge valve wing 571 makes close contact with the sealing protruding ring 544 or is spaced apart from the sealing protruding ring 544, the discharge valve 57 is formed of a material having excellent elasticity. Accordingly, the discharge valve 57 is preferably formed of at least one of materials, such as general rubber, elastomer, silicone rubber, NBR rubber, polyethylene (PE), and polypropylene (PP), which represent excellent elasticity.

The elastic member 58 is fitted around an outer portion of the pump inner body 56, so that a lower end of the elastic member 58 is mounted on the lower side surface extension piece 567 of the pump inner body 56, and an upper end of the elastic member 58 elastically supports a lower portion of the upper side surface extension piece 566 to extend the pump inner body 56 vertically, and elastically supports the pump main body 52 coupled to the lower side surface extension piece 567 and the pump upper body 34 coupled to the upper side surface extension piece 566.

The elastic member 58 may include one of a synthetic material, elastomer, a rubber material, and a metallic material. Since the elastic member 58 is located outside the pump inner body 56, the elastic member 58 does not make contact with the contents to prevent the contents from being contaminated due to chemical change, so that the endurance of the contents can be improved.

The discharge-valve coupling member 59, which is coupled to the upper portion of the discharge valve 57, is coupled to the discharge valve coupling space 542 of the pump upper body 54 to prevent the deviation of the discharge valve 57. The discharge valve 57 may be coupled to the discharge valve coupling space 542 of the pump upper body 54 individually or through the discharge-valve coupling member 59.

The discharge-valve coupling member 59 is formed at a lower portion thereof with first and second coupling protruding rings 591 and 592 to form a coupling groove 593, which is coupled to the auxiliary coupling protruding ring 572 of the discharge valve 57, between the first and second coupling protruding rings 591 and 592. The coupling protruding ring 591 is formed in a lateral side thereof with a coupling groove 594 coupled to a coupling step 545 of the discharge valve coupling space 542 of the pump upper body 54, and formed at an upper portion thereof with a second content discharge port 595 to discharge the contents.

Hereinafter, an assembling method of the foundation container including the discharge pump having the short working stroke, which has the above configuration according to the present invention, will be described.

The outer container main body 10 is hinged with the outer container cap 20. In addition, the container main body 30, the container cap 40, and the puff cap 42 are hinged with each other.

Further, the container main body 30 coupled to the container cap 40 is inserted into the outer container main body 10 in the state that the container cap 40 is open, and coupled to the outer container main body 10. The subsequent assembling process is performed in the state that the container cap 40 is open from the container main body 30.

After coupling the thin auxiliary container 32 or the pushing plate 3000 to the inner portion of the container main body 30, the container interruption plate 34, the discharge pump 50, and the content diffusing plate 60 are coupled to the upper portion of the container main body 30. Hereinafter, the details will be described.

After coupling the thin auxiliary container 32 or the pushing plate 3000 to the inner portion of the container body 30, the container interruption plate 34 is coupled to the upper portion of the container main body 30.

In addition, the pump inner body 56 is mounted in the pump main body 52 formed integrally with the container Interruption plate 34. In detail, the lower coupling extension piece 568 of the pump inner body 56 is inserted into the inner body coupling groove 525, and the lower side surface extension piece 567 is undercut-coupled to the inner body locking step 524, and the intake-port annular protrusion 523 is inserted into the close contact groove 569-1 of the intake valve plate 563, and coupled to the close contact groove 569-1 of the intake valve plate 563.

Next, after the elastic member 58 is fitted around the pump inner body 56, the lower end of the elastic member 58 is mounted on the lower side surface extension piece 567 of the pump inner body 56, and the upper end of the elastic member 58 is located to elastically support the lower portion of the upper side surface extension piece 566 of the pump inner body 56.

In addition, the pump upper body 54 is coupled to the upper portion of the pump inner body 56, and the pump upper body 54 is formed integrally with the content diffusing plate 60.

The upper side surface extension piece 566 of the pump inner body 56 is inserted and coupled between the first coupling-extension member 546 and the second coupling-extension member 547 of the pump upper body 54, and the lower end of the first coupling-extension member 546 is coupled in contact with the horizontal connection piece 564 of the pump inner body 56. A coupling protrusion 61 of the content diffusing plate 60 formed integrally with the pump upper body 54 is fitted into a coupling groove 341 of the container interruption plate 34.

Thereafter, the discharge valve 57 is inserted into the discharge valve coupling space 542 of the pump upper body 54 so that the discharge valve wing 571 makes close contact with the outer circumference of the sealing protruding ring 544. The discharge valve 57 is forcibly inserted into or undercut-coupled to the discharge valve coupling space 542 of the pump upper body 54. Alternatively, the discharge valve 57 may be coupled to the discharge valve coupling space 542 by further using the discharge-valve coupling member 59.

When the discharge-valve coupling member 59 is used, the discharge-valve coupling member 59 is coupled to the upper portion of the discharge valve 57. In this case, the discharge-valve coupling member 59 is inserted into the discharge valve coupling space 542 of the pump upper body 54. In addition, the coupling groove 594 of the discharge-valve coupling member 59 is coupled to the coupling step 545 of the pump upper body 54.

Next, the fixing member 80 is fitted between the outer wall 35 and the inner wall 36 of the container main body 30. In this case, the top surface of the fixing ember 80 presses an outer upper portion of the container interruption plate 34 and the outer upper portion of the content diffusing plate 60 to prevent the deviation of the container interruption plate 34 and the content diffusing plate 60.

If necessary, as shown in FIG. 17, the immersing member 70 may be securely mounted on the content diffusing plate 60 for the use thereof.

Hereinafter, the operation of the foundation container including the discharge pump having the short working stroke according to the present invention as described above will be described.

In order to use the contents of the foundation container including a discharge pump having short working-stroke as configured above, the upper portion of the pump upper body 54 or the immersing member 70 is pressed by the puff 90.

If the pump upper body 54 is moved down by the pressing, the inner body barrel wall 561 of the pump inner body 56 is folded, so that the volume of a temporary content storage part TR is reduced. Accordingly, pressure is applied to the temporary content storage part TR, and contents are intended to be discharged to the outside from the temporary content storage part TR due to the pressure. Accordingly, the intake valve plate 563 closes the content intake port 522 due to the discharge pressure. Simultaneously, the contents are pushed out of the temporary content storage part TR through the content discharge port 543, so that the discharge valve wing 571 of the discharge valve 57 in close contact with the sealing protruding ring 544 is spread, so that the contents are discharged to the outside.

When the discharge-valve coupling member 59 is coupled, the contents, which are discharged as the discharge valve wing 571 of the discharge valve 57 is open after passing through the content discharge port 543, are discharged to the outside through the second content discharge port 595 of the discharge-valve coupling member 59.

Figure 12:
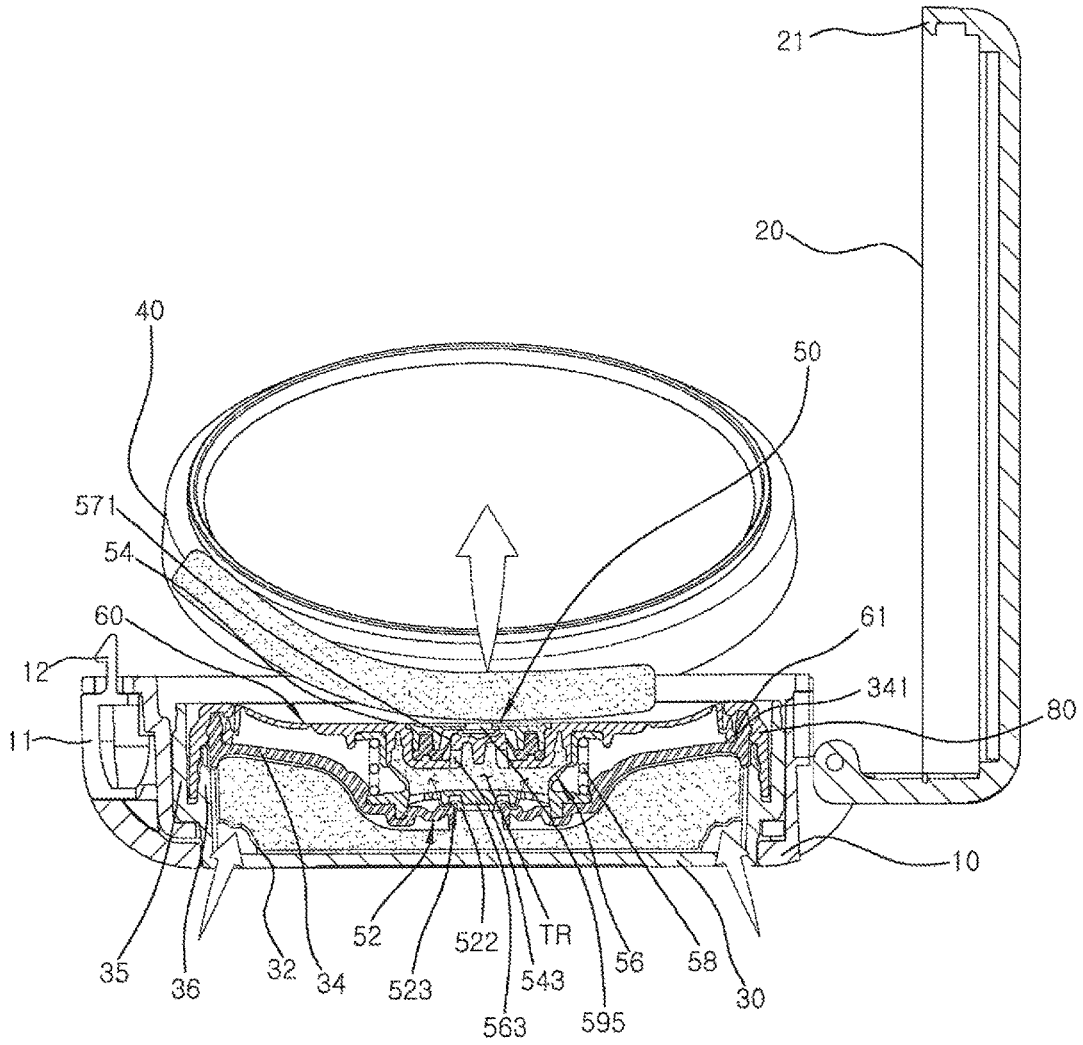
FIG. 12 is a view showing that the foundation container is recovered to the original state thereof as the press applied to the foundation container is released according to the related art.

Thereafter, as shown in FIG. 12, if force applied to the pump upper body 54 is released, the pump upper body 54 is moved up due to the elasticity of the elastic member 58 while the inner body barrel wall 561 of the pump inner body 56 is returned to an original state thereof. Accordingly, the space of the temporary content storage part TR is increased, in the pump inner body 56, so that the vacuum pressure is generated.

Accordingly, the discharge valve wing 571 of the discharge valve 57 makes close contact with the sealing protruding ring 544 to close the content discharge port 543, and the central portion of the intake valve plate 563 is lifted up due to the vacuum pressure in the temporary content storage part TR, so that the gap between the intake-valve-plate annular protrusion 569 and the intake-port annular protrusion 523 is increased. Accordingly, the contents in the thin auxiliary container 32 are moved into the temporary content storage part TR.

As the contents in the thin auxiliary container 32 is moved into the temporary content storage part TR of the discharge pump 50, the vacuum pressure is generated in the thin auxiliary container 32. Accordingly, the thin auxiliary container 32 is separated from the container main body 30 and shrunken as shown in FIG. 12.

In addition, according to another embodiment, when the pushing plate 3000 is mounted in the container main body 30 instead of the thin auxiliary container 32 as shown in FIG. 1, the pushing plate 3000 pushes the contents toward the content intake port of the discharge pump 50 by the vacuum pressure generated as the contents are moved into the content temporary place TR of the discharge pump 50 from the container main body 30.

The contents passing through the content intake port 522 are moved into the temporary content storage part TR of the pump inner body 56. If the vacuum pressure of the temporary content storage part TR is disappeared as the contents are moved, the intake valve plate 563 is returned to the original state due to the elasticity of the elastic piece 562, and the intake-valve-plate annular protrusion 569 makes close contact with the intake-port annular protrusion 523 to close the content intake port 522.

The contents discharged through the pumping operation of the discharge pump 50 are moved to the content diffusing plate 60. In this case, a user can apply the contents to the puff 90 for the use thereof.

When the immersing member 70 is mounted on the content diffusing plate 60, the contents, which have been moved to the content diffusing plate 60, are uniformly immersed into the entire portion of the immersing member 70. Accordingly, the user applies the contents to the puff 90 for the use thereof.

As described above, although the foundation container including the discharge pump having the short working stroke has been described according to one embodiment of the present invention for illustrative purpose, the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Outer container main body
20: Outer container cap
30: Container main body
32: Thin auxiliary container
34: Container interruption plate
40: Container cap
42: Puff cap
50: Discharge pump
52: Pump main body
521: Main body lower plate
523: Intake-port annular protrusion
54: Pump upper body
541: Upper body upper plate 541
542: Discharge valve coupling Space
543: Content discharge port

544: Sealing protruding ring
546: First coupling-extension member
547: Second coupling-extension member
56: Pump inner body
561: Inner body barrel wall
562: Elastic piece
563: Intake valve plate
564: Horizontal connection piece
565: vertical coupling piece
566: Upper side surface extension piece
567: Lower side surface extension piece
569: Suction-valve-plate annular protrusion
57: Discharge valve
571: Discharge valve wing
58: Elastic member
59: Discharge-valve coupling member
60: Content diffusing plate
80; Fixing member

The invention claimed is:

1. A foundation container including a discharge pump having a short working stroke, an outer container main body (10), an outer container cap (20) coupled to the outer container main body (10) to be open or closed, a container main body (30) coupled to an inner portion of the outer container main body (10), and a container cap (40) coupled to an upper portion of the container main body (30) to be open or closed, the foundation container comprising:

a container interruption plate (34) coupled to an inner upper portion of the container main body (30);

a discharge pump (50) coupled to a center of the container interruption plate (34); and a content diffusing plate (60) coupled to the discharge pump (50), wherein the discharge pump (50) includes a pump main body (52), a pump upper body (54), a pump inner body (56), a discharge valve (57), and an elastic member (58), the container interruption plate (34) extends to the pump main body (52), and the content diffusing plate (60) extends to the pump upper body (54), and wherein the pump main body (52) is formed at a lower portion thereof with a main body lower plate (521), and the main body lower plate (521) is formed at a center thereof with a content intake port (522).

2. The foundation container of claim 1, further comprising a thin auxiliary container (32) additionally coupled to an inner portion of the container main body (30).

3. The foundation container of claim 1, further comprising a pushing plate additionally coupled to an inner portion of the container main body (30).

4. The foundation container of claim 1, further comprising an immersing member (70) additionally coupled to an upper portion of the content diffusing plate (60).

5. The foundation container of claim 1, wherein the pump upper body (54) is formed at an upper portion thereof with an upper body upper plate (541), and a sealing protruding ring (544) formed therein with a content discharge port (543) is formed in the upper body upper plate (541).

6. The foundation container of claim 1, wherein the pump upper body (54) has a discharge valve coupling space (542) which is recessed in an upper body upper plate (541).

7. The foundation container of claim 1, wherein the pump inner body (56) has lateral sides including inner body barrel walls (561), and is formed at an inner lower portion thereof with an intake valve plate (563) coupled to an elastic member (562).

8. The foundation container of claim 1, wherein the discharge valve (57) is formed at an inner side thereof with a discharge valve wing (571).

9. A foundation container including a discharge pump having a short working stroke, an outer container main body (10), an outer container cap (20) coupled to the outer container main body (10) to be open or closed, a container main body (30) coupled to an inner portion of the outer container main body (10), and a container cap (40) coupled to an upper portion of the container main body (30) to be open or closed, wherein a thin auxiliary container (32) or a pushing plate (3000) is coupled to an inner portion of the container main body (30), a container interruption plate (34), the discharge pump (50), and a content diffusing plate (60) are coupled to the upper portion of the container main body (30), a pump inner body (56) is mounted in a pump main body (52) formed integrally with the container interruption plate (34), an elastic member (58) is fitted around the pump inner body (56), a lower end of the elastic member (58) is mounted on a lower side surface extension piece (567) of the pump inner body (56), an upper end of the elastic member (58) is placed under an upper side surface extension piece (566) of the pump inner body (56) such that the upper end of the elastic member (58) is elastically supported, a pump upper body (54) formed integrally with a content diffusing plate (60) is coupled to an upper portion of the pump inner body (56), a discharge valve (57) is coupled such that a discharge valve wing (571) of the discharge valve (57) makes close contact with an outer circumference of a sealing protruding ring (544) of the pump upper body (54), and a top surface of a fixing member (80) is coupled to the container main body (30) to press an outer upper portion of the container interruption plate (34) and an outer upper portion of the content diffusing plate (60).

10. The foundation container of claim 9, wherein the pump main body (52) is formed at a lower portion thereof with a main body lower plate (521), and the main body lower plate (521) is formed at a center thereof with a content intake port (522).

11. A foundation container including a discharge pump having a short working stroke, an outer container main body (10), an outer container cap (20) coupled to the outer container main body (10) to be open or closed, a container main body (30) coupled to an inner portion of the outer container main body (10), and a container cap (40) coupled to an upper portion of the container main body (30) to be open or closed, wherein a pump upper body (54) is moved down as the pump upper body (54) is pressed such that an inner body barrel wall (561) of a pump inner body (56) is folded to reduce a volume of a temporary content storage part (TR) and to generate pressure in the temporary content storage part (TR), an intake valve plate (563) closes a content intake port (522) by discharge pressure while a contents are pushed out of the temporary content storage part (TR) through a content discharge port (543) to spread a discharge valve wing (571) of a discharge valve (57) in close contact with a sealing protruding ring (544), such that the contents are discharged to a content diffusing plate (60), the pump upper body (54) is moved up due to elasticity of an elastic member (58) if force applied to the pump upper body (54) is released, the inner body barrel wall (561) of the pump inner body (56) is returned to an original state thereof, a space of the temporary content storage part (TR) is increased in the pump inner body (56), such that a vacuum pressure is generated, the discharge valve wing (571) of the discharge valve (57) makes close contact with the sealing protruding ring (544) to close a content discharge port (543), a central portion of the intake valve plate (563) is lifted up due to the vacuum pressure in the temporary content storage part (TR) to increase a gap between an intake-valve-plate annular protrusion (569) and an intake-port annular protrusion (523) such that the contents in a thin auxiliary container (32) are moved into the temporary content storage part (TR), and the thin auxiliary container (32) is separated from the container main body (30) and shrunken.

12. The foundation container of claim 11, further comprising an immersing member (70) additionally coupled to an upper portion of the content diffusing plate (60).

13. The foundation container of claim 11, wherein the pump upper body (54) is formed at an upper portion thereof with an upper body upper plate (541), and the sealing protruding ring (544) formed therein with a content discharge port (543) is formed in the upper body upper plate (541).

14. The foundation container of claim 11, wherein the pump upper body (54) has a discharge valve coupling space (542) which is recessed in an upper body upper plate (541).

15. The foundation container of claim 11, wherein the pump inner body (56) has lateral sides including inner body barrel walls (561), and is formed at an inner lower portion thereof with the intake valve plate (563) coupled to an elastic member (562).

16. The foundation container of claim 15, wherein the inner body barrel wall (561) is formed at an upper portion thereof with a vertical coupling piece (565) coupled to a horizontal connection piece (564).

17. The foundation container of claim 11, wherein the discharge valve (57) is formed at an inner side thereof with the discharge valve wing (571).

* * * * *